US007073274B2

(12) United States Patent
Yoshida

(10) Patent No.: US 7,073,274 B2
(45) Date of Patent: Jul. 11, 2006

(54) DRYING DEVICE

(75) Inventor: Futoshi Yoshida, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 9 days.

(21) Appl. No.: 11/033,260

(22) Filed: Jan. 12, 2005

(65) Prior Publication Data

US 2005/0150131 A1 Jul. 14, 2005

(30) Foreign Application Priority Data

Jan. 14, 2004 (JP) ..... 2004-006941

(51) Int. Cl.
*F26B 13/06* (2006.01)

(52) U.S. Cl. ..... 34/619; 629/636; 629/654; 629/655; 629/656; 101/424.1; 347/102

(58) Field of Classification Search ..... 34/619.629, 34/636, 654, 655, 656; 101/424.1, 487; 347/102, 347/104

See application file for complete search history.

(56) References Cited

U.S. PATENT DOCUMENTS

| | | | | |
|---|---|---|---|---|
| 2,280,704 | A * | 4/1942 | Hurxthal | 34/212 |
| 4,270,283 | A * | 6/1981 | Ellis | 34/212 |
| 6,183,146 | B1 * | 2/2001 | Kusunoki | 396/579 |
| 6,536,863 | B1 * | 3/2003 | Beauchamp et al. | 347/17 |
| 6,735,882 | B1 * | 5/2004 | Takahashi | 34/212 |

FOREIGN PATENT DOCUMENTS

| | | |
|---|---|---|
| JP | 5-249646 A | 9/1993 |
| JP | 2003-287865 A | 10/2003 |

* cited by examiner

*Primary Examiner*—S. Gravini
(74) *Attorney, Agent, or Firm*—Sughrue Mion, PLLC

(57) ABSTRACT

In a dry air blowing plate, rows of dry air outlets are arranged at given intervals in a transport direction of a photosensitive material. The interval between the dry air outlets within the row is narrower in a front zone of the dry air blowing plate that is close to a dry air inlet, whereas the interval is wider in a rear zone of the dry air blowing plate that is away from the dry air inlet. In the front zone, the velocity of dry air is lower but the aperture rate per unit area is larger. On the other hand, in the rear zone, the velocity of dry air is higher but the aperture rate is smaller. As a result, the volume of blown dry air is almost the same throughout an external surface of the dry air blowing plate, so the dry air is evenly blown to a surface of a photosensitive material.

10 Claims, 6 Drawing Sheets

DRYING DEVICE

FIELD OF THE INVENTION

The present invention relates to a drying device that dries a recording medium, especially a photosensitive material after going through photo-finishing solutions.

BACKGROUND ART

In the case of an automatic processor like a printer processor used to develop photo prints, a photosensitive material such as photographic printing paper is cut by a cutter according to a size of photo prints into a cut-sheet photosensitive material, on which photo printing is done. After the printing process, the photosensitive material is distributed into single line or plural lines at a distribution section and then conveyed to a developing section. Generally, the developing section develops the photosensitive material by conveying it to processing tanks by conveyer rollers and by letting it pass through respective processing liquids one after another.

The developed photosensitive material is wet with moisture from the tanks. For this reason, the developed photosensitive material is removed water at a squeezing section and then is conveyed to a dry section where it is dried. The dry section includes a conveyer rack that conveys the photosensitive material, a fan and a heater. The fan blows air heated by the heater to dry the photosensitive material. Since how the dry section dries the photosensitive material affects the quality of it very much, various kinds of devices that firmly dry a wet photosensitive material after being developed have been invented.

For example, a drying device disclosed in Japanese Laid-open Patent Application No.-H05-249646 has a number of cylinders along a transport direction of a photosensitive material, aligning a longitudinal direction of the cylinders with a direction perpendicular to the transport direction. Each of these cylinders has a slit in its longitudinal direction on a facing side to the photosensitive material, from which dry air is blown to the photosensitive material. Moreover, the cylinder narrows the width according as it is away from a dry air inlet, changing cross-section area of its aperture, to allow dry air to blow from across the slit in almost uniform air volume. A plural number of such cylinders are provided on both sides of a path of the photosensitive material, so that dry air comes from both sides of the photosensitive material as it is conveyed along the path. The photosensitive material is conveyed by a lot of nipping rollers installed on the path. This system, however, needs plural cylinders and a lot of nipping rollers, which increases the number of components and production cost.

Another drying device known from Japanese Laid-open Patent Application No. 2003-287865 has a fan duct along a path of a photosensitive material. A guide component (a dry air blowing component) is installed on a facing side of the fan duct to the material path. The guide component has dry air outlets at specified intervals. Dry air sent from a dry air inlet into the fan duct blows from the dry air outlets to the photosensitive material. The photosensitive material blown dry air from the dry air outlets is conveyed being pressed on an endless belt made from a mesh.

The drying device used in the latter prior art needs less number of components and is simpler in structure than one used in the former prior art. In the drying device used in the latter prior art, however, the volume of dry air blown from dry air outlets to the photosensitive material is so uneven that it sometimes caused irregular dry condition in the material or jerky transport of the material because curled edges were caught in the outlets.

SUMMARY OF THE INVENTION

An object of the present invention is to provide a drying device that prevents irregular dry condition of a photosensitive material and offers smooth transport of the photosensitive material.

According to the present invention, a drying device for drying a recording medium comprises a blower mechanism for generating dry air and sending it out; a duct disposed along a transport path of the recording medium and supplied with the dry air from the blower mechanism, the duct comprising a dry air blowing member on a side facing to the transport path; a plural number of air outlets formed through the dry air blowing member, to blow the dry air to the recording medium through the air outlets, wherein the air outlets are formed at a smaller aperture rate in a zone where pressure of the dry air on inner surface of the dry air blowing member is larger, the aperture rate being an area rate of apertures of the air outlets per unit area of the dry air blowing member; and a conveyer mechanism for conveying the recording medium along the transport path, the conveyer mechanism being placed across the transport path from the dry air blowing member, wherein the recording medium is held on the conveyer mechanism by virtue of the dry air blown from the air outlets to the recording medium. According to a preferred embodiment of the drying device, the duct has a parallelepiped shape, of which a first side facing to the transport path is provided with the dry air blowing member, and three of four vertical sides to the first side are closed, whereas a remaining one of the four vertical sides is provided with a dry air inlet for letting the dry air from the blower mechanism in the duct, wherein the aperture rate of the dry air blowing member is set smaller with distance from the dry air inlet. It is preferable to chamfer an inner periphery of each air outlet on the side of the transport path.

On the assumption that dry air flows from inside to outside of the dry air blowing member through the outlets, the aperture rate, which represents how much area apertures of the dry air outlets occupy per unit area of the dry air blowing member, becomes smaller in those zones where the pressure of the dry air on an inner surface is higher.

Therefore, in those zones where the internal pressure of the dry air blowing component is high, the velocity of dry air is high, but the aperture rate is small. Comparatively, in those zones of the dry air blowing component where the internal pressure is lower, the velocity dry air is slower and the aperture rate is larger. As a result, it is possible to make the volume of blown dry air per unit area almost even throughout an external surface of the dry air blowing component. Because this allows dry air to evenly blow to a surface of a recording medium, the recording medium is dried evenly without any irregular dry condition. Moreover, evenness of dry air to the surface of the recording medium enables pressing the recording medium onto a conveyer mechanism with a uniform force, and guarantees smooth transport of the recording medium while preventing it from slipping on the conveyer mechanism.

Chamfering the internal periphery of each individual dry air outlet of the dry air blowing member on its external side, i.e. on its paper path side, prevents an edge of the recording medium from being caught in the internal periphery of the dry air outlet, even if the recording medium curls because of some reasons including over-dryness.

BRIEF DESCRIPTION OF THE DRAWINGS

The above and other objects and advantages will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
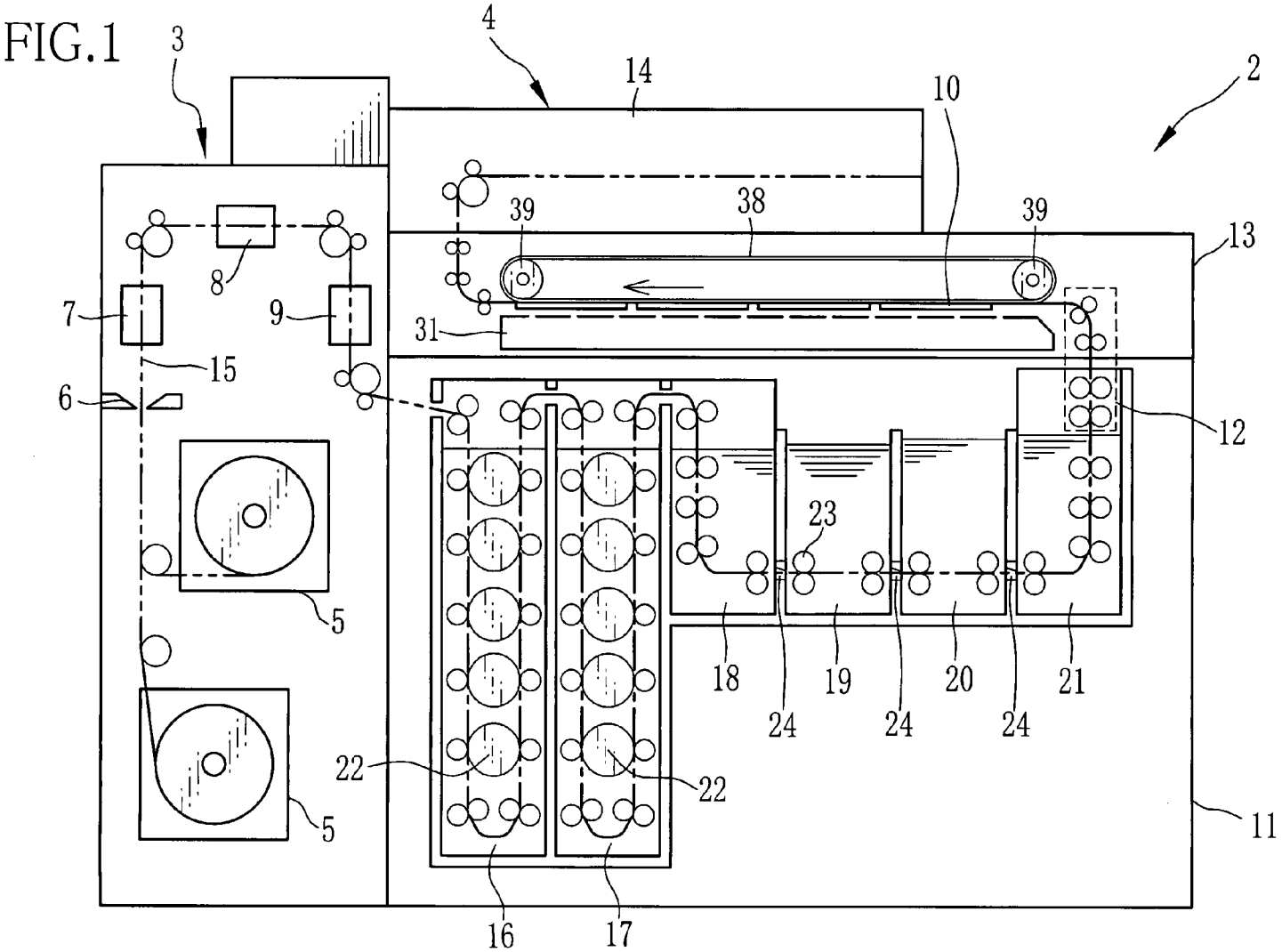
FIG. 1 is a schematic diagram illustrating a printer processor with a drying device according to an embodiment of the present invention.

As FIG. 1 shows, a printer processor 2 consists of a printer section 3 and a processor section 4. The printer section 3 has a magazine 5, a cutter 6, a back printing section 7, an exposure section 8 and a distribution section 9. A web of photosensitive material set in the magazine 5 is cut by the cutter 6 according to a size of photo prints into cut sheets of the photosensitive material 10. The photosensitive material 10 is printed on its back side a frame number and corrected data at the back printing section 7 on its way to the exposure section 8 along a paper path 15 in FIG. 1. The exposure section 8 carries out exposure recording of images based on image data on a light-receptive surface of the photosensitive material 10. The exposed photosensitive material 10 is then distributed into some rows at the distribution section 9 and conveyed to the processor section 4.

The processor section 4 has a developing section 11, a squeezing section 12, a dry section 13 and a sorter section 14. The developing section 11 is provided with a developing tank 16, a bleach fix tank 17 and the first to fourth wash tanks 18, 19, 20 and 21, starting from the upstream of the transport direction. The developing tank 16, the bleach fix tank 17, and the first to fourth wash tanks 18 to 21 store a given amount of developing solution, bleach-fix bath and wash water respectively. Inside the developing tank 16 and the bleach fix tank 17, there are conveyer racks 22 that consist of many conveyer rollers conveying the photosensitive material 10 along an almost U-shaped path in both tanks.

In the wash tanks 18 to 21 there are many pairs of conveyer rollers 23 conveying the photosensitive material 10 along an almost U-shaped path in these tanks. The photosensitive material 10 is developed during being conveyed from the tank 16 to the tank 21 by the conveyer racks 22 and the pairs of conveyer rollers 23.

Among the tanks 18 to 21, the photosensitive material 10 is sent to the next tank through a submerged squeezing section 24 in a partition wall. The submerged squeezing section 24 has a blade made from a resilient laminate that allows pass of the photosensitive material 10 but prevents outflow of the wash water. The developed photosensitive material 10 is removed water on it at the squeezing section 12 and sent to the dry section 13. Instead of using the submerged squeezing section 24, it is also possible to use a transport method by conveyer racks like in other tanks 16 and 17.

Figure 2:
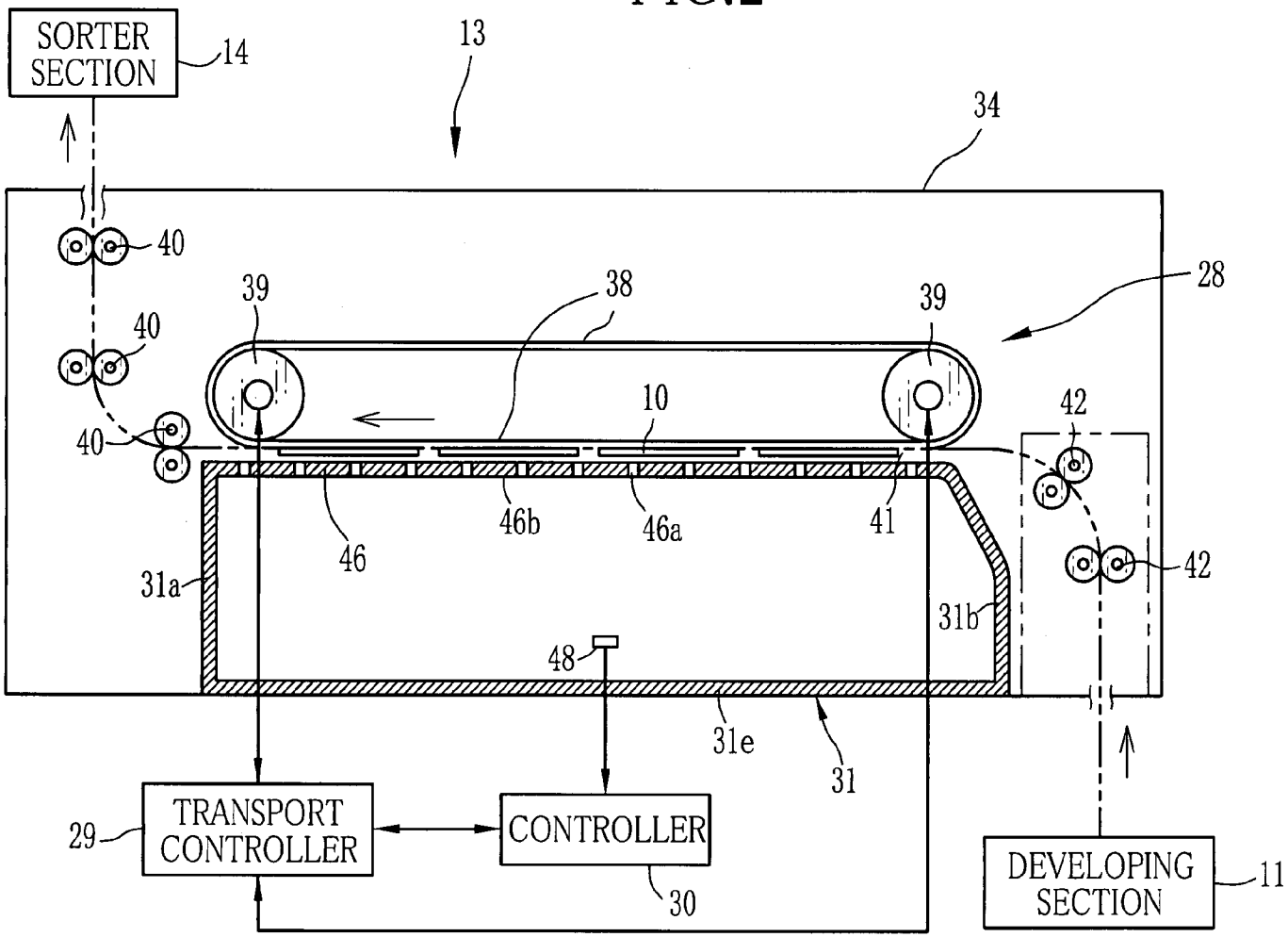
FIG. 2 is a schematic front view illustrating the interior of a dry section.
Figure 3:
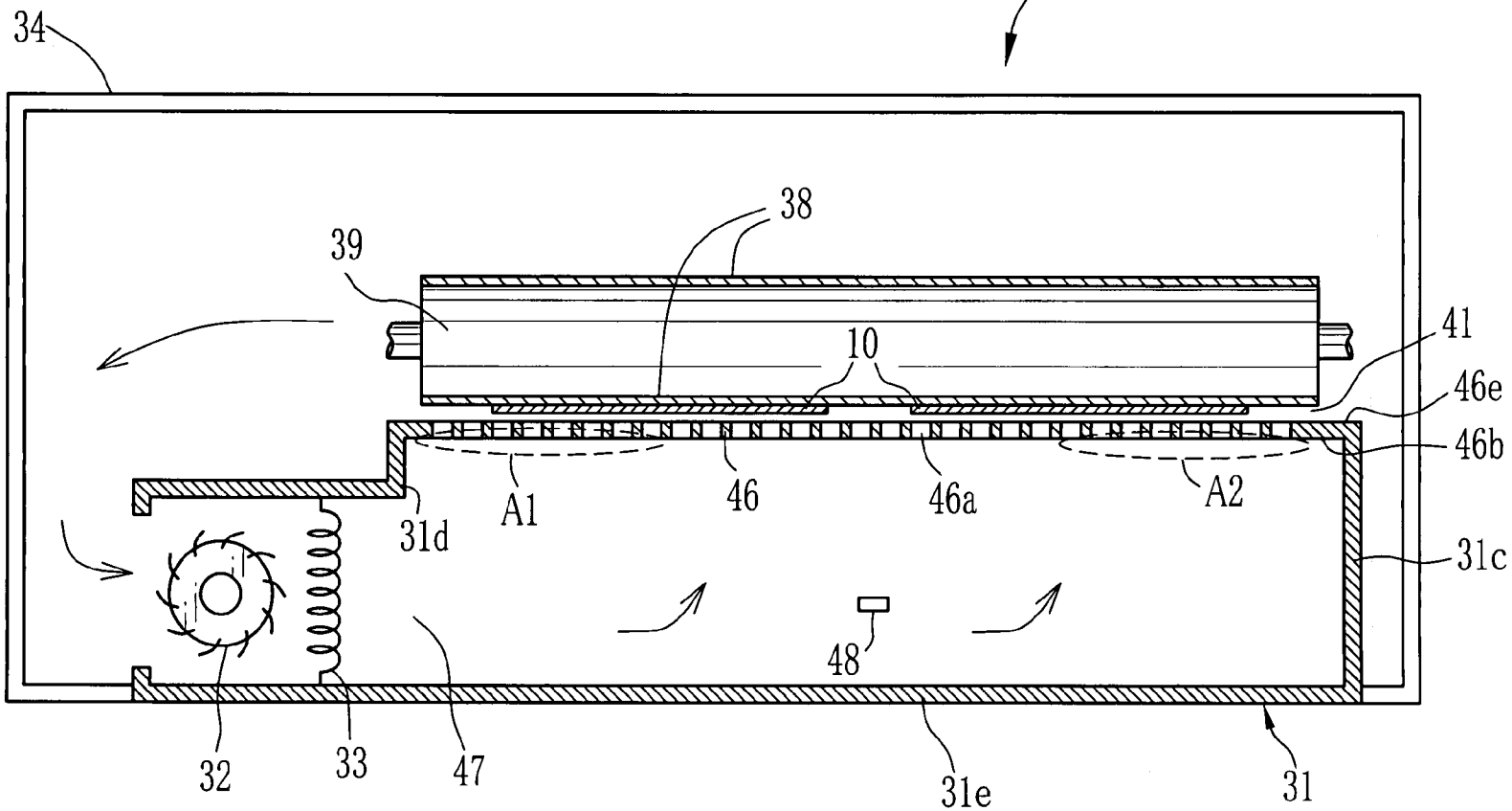
FIG. 3 is a schematic side view illustrating the interior of the dry section.

As FIG. 2 shows, the dry section 13 has its purpose to dry a washed photosensitive material 10 and consists of a conveyer mechanism 28, a transport controller 29, a controller 30, a duct 31, a fan 32 (see FIG. 3) and a heater 33 (see FIG. 3.)

The conveyer mechanism 28, the duct 31, the fan 32 and the heater 33 are installed inside a dry room 34 in the printer processor 2.

The conveyer mechanism 28 has a conveyer belt 38, conveyer belt rollers 39 and pairs of conveyer rollers 40, and all of them form a paper path 41 conveying the photosensitive material 10. The conveyer belt 38 uses an endless belt made from a mesh and rolled around the conveyer belt rollers 39. The conveyer belt rollers 39 are turned responsive to a signal sent from the transport controller 29, to drive the conveyer belt 38 in the direction of an arrow in FIG. 2. The photosensitive material 10 is pressed on the conveyer belt 38 by dry air blown from an after-mentioned dry air blowing plate 46. This pressure fixes the photosensitive material 10 onto the conveyer belt 38. As long as the dry air is blowing toward the photosensitive material 10, the conveyer belt 38 can convey the photosensitive material 10. The pairs of conveyer rollers 40 convey the dried photosensitive material 10 by nipping it to the sorter section 14.

The transport controller 29 controls driving of the conveyer belt rollers 39 and the conveyer roller pairs 40. The transport controller 29 conveys the photosensitive material 10 at an appropriate speed for drying by turning the conveyer belt rollers 39 to drive the conveyer belt 38 based on a signal sent from the controller 30. The signal from the controller 30 is representative of a size or a kind of the photosensitive material 10. The controller 30 also controls every part of the printer processor 2 as well as the fan 32.

The duct 31 with a rectangular parallelepiped shape is provided along the paper path 41 conveying the photosensitive material 10. A top face of the duct 31, which is on the paper path side, is formed by the dry air blowing plate 46 with dry air outlets 46*a* through which dry air is blown to the photosensitive material 10. The dry air blowing plate 46 has a given distance from the conveyer belt 38. Among perpendicular faces to the dry air blowing plate 46, a left side 31*a* and a right side 31*b* in FIG. 2 and a rear side 31*c* (see FIG. 3) are closed. On a front side 31*d* (see FIG. 3), a dry air inlet 47 that supplies dry air from the fan 32 into the duct 31 is formed widely along the transport direction. In other words, the dry air flows into the duct 31 transversely to the transport direction of the photosensitive material 10. A bottom face 31*e* opposite to the top face of the duct 31 is also closed.

The fan 32 in FIG. 3 is composed of a cross-flow fan. The cross-flow fan extends along the transport direction with its rotary axis in parallel to the transport direction. The fan 32 is placed close to the dry air inlet 47 of the duct 31 and sends air from outside into the duct.

There is a heater 33 between the fan 32 and the dry air inlet 47, to dry the air sent into the duct. The heater 33 heats the air up to about 60° C. to 90° C. The heater 33 is controlled by the controller 30 based on a detection signal from a temperature sensor 48 in the duct 31. This system maintains a temperature of dry air in the duct 31 within a specific range. Moreover, the duct 31 has a fresh air intake to maintain the humidity of circulating dry air within a specific range although it isn't shown in any Figures.

Internal pressure of the duct 31 is higher than its external pressure because of the dry air sent from the dry air inlet 47. The internal pressure differs according to the location in the duct 31. Specifically, pressure on an inner surface 46*b* of the dry air blowing plate 46 tends to be lower in a front zone A1 close to the dry air inlet 47 (see FIGS. 3 and 4), and tends to be higher in a rear zone A2 away from the dry air inlet 47 (see FIGS. 3 and 4). According to the present invention, the dry air blowing plate 46 is provided with the dry air outlets 46*a* at a lower aperture rate in the zones where the pressure on the inner surface 46*b* is higher. Therefore, the dry air blowing plate 46 has the dry air outlets 46*a* whose aperture rate is smaller as they are away from the dry air inlet 47. The aperture rate is an area rate of apertures of the dry air outlets 46*a* calculated per unit area of the surface of the dry air blowing plate 46.

Figure 4:
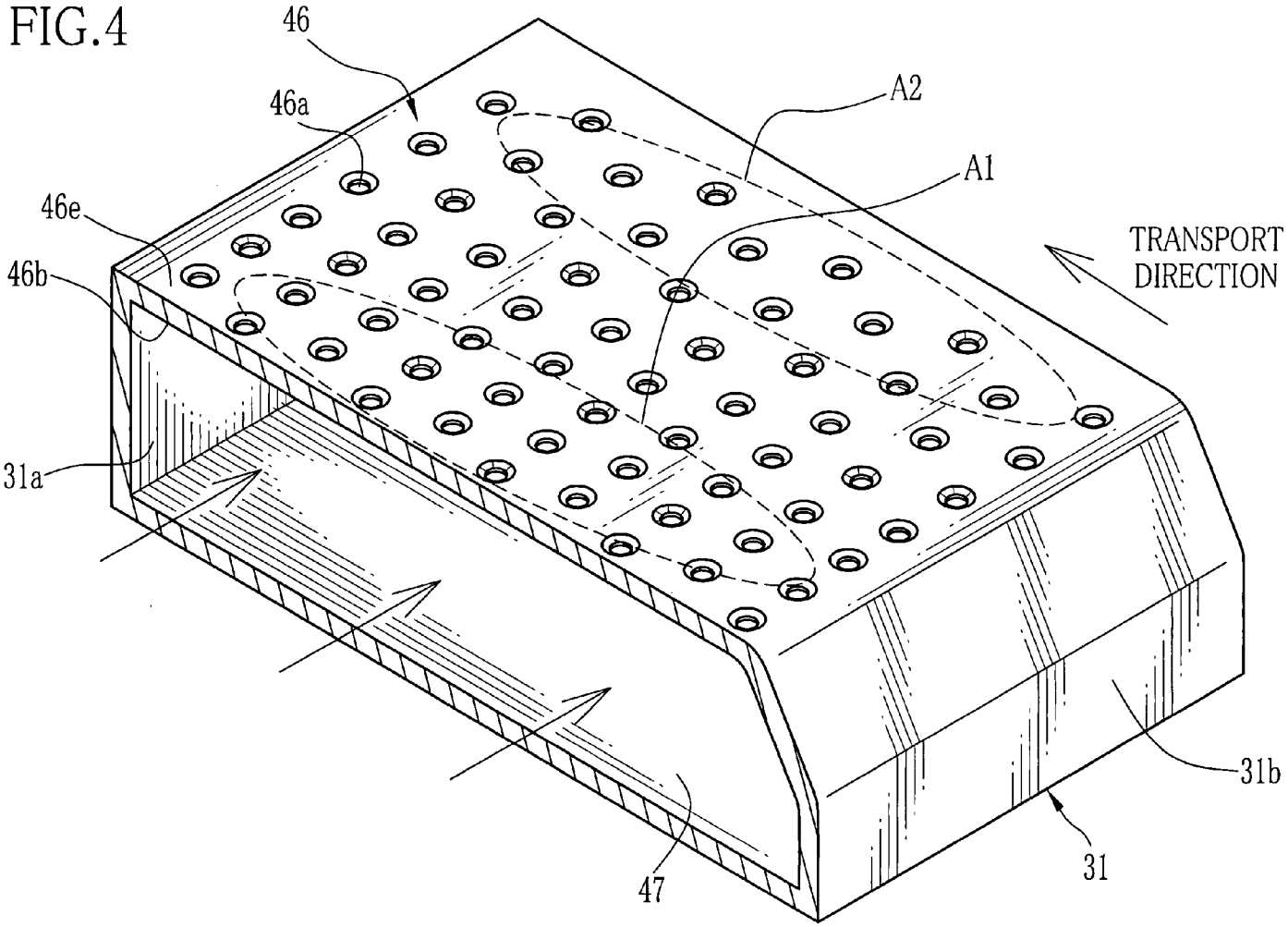
FIG. 4 is a fragmentary perspective view illustrating a duct having a dry air blowing plate on its top surface.

As FIG. 4 shows, in the dry air blowing plate 46, rows of dry air outlets 46*a* are lined at given intervals in the transport direction of the photosensitive material 10. An aperture of the dry air outlet 46*a* is round. Within each row of the dry air outlets 46*a*, an interval between adjacent dry air outlets 46*a* is narrower in the front zone A1 that is close to a dry air inlet 47 and the interval is wider in the rear zone A2 away from the dry air inlet 47. Thus, the aperture rate is smaller as the dry air outlets 46*a* in the dry air blowing plate 46 are located away from the dry air inlet 47.

Meanwhile, it is known that a volume of dry air per unit area blown from the dry air blowing plate 46 is a product value of the aperture rate and velocity of dry air. In the front zone A1 where the pressure on the inner surface 46*b* of the dry air blowing plate 46 is lower, the velocity of dry air is not high because there is a small difference between external and internal pressures, but the aperture rate is set larger in this zone A1. On the other hand, in the rear zone A2 where a pressure on the inner surface 46*b* of the dry air blowing plate 46 is higher, the velocity of the dry air is higher because there is a larger difference between external and internal pressures, but the aperture rate is set smaller in this zone A2. As a result, the volume of blown dry air per unit area is almost the same both in the low pressure zone A1 and the high pressure zone A2.

When the volume per unit area of the dry air blown from the dry air blowing plate 46 is almost the same in every location, the photosensitive material 10 conveyed above the dry air blowing plate 46 receives the dry air evenly.

Figure 5:
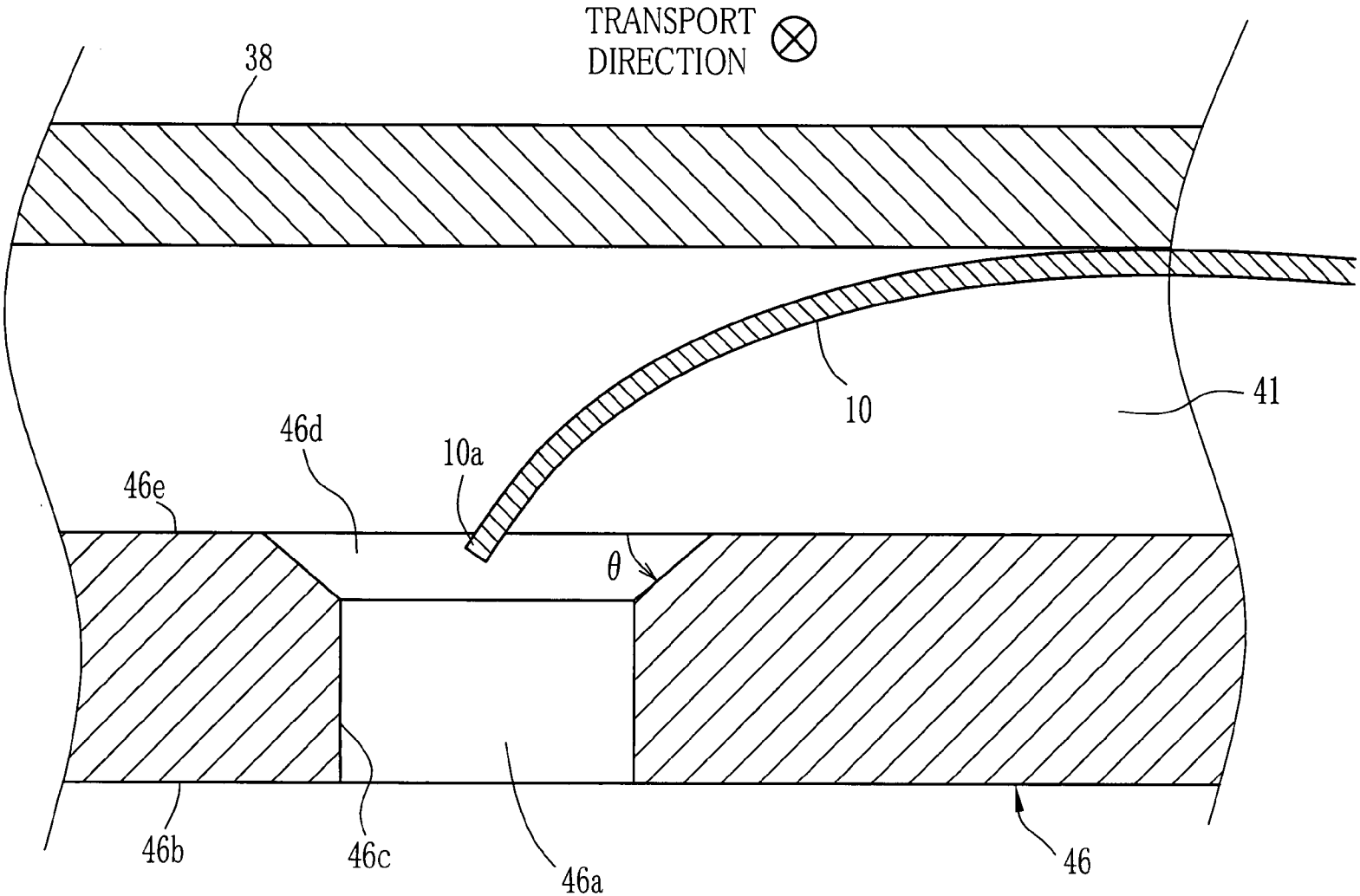
FIG. 5 is an explanatory view illustrating a curled photosensitive material during its transport.

As FIG. 5 shows, outer edges of an internal periphery 46*c* of each dry air outlet 46*a* of the dry air blowing plate 46 are chamfered to form a cutout surface 46*d*. As for an angle of chamfer, it is preferable that an angle θ from an external surface 46*e* of the dry air blowing plate 46 to the cutout surface 46*d* is less than thirty degrees. The chamfer prevents an edge area 10*a* of the conveyed photosensitive material 10 from being caught in the dry air outlet 46*a*. The details will be explained later.

In an example, the dry air blowing plate 46 and the dry air outlets 46*a* are sized such that the thickness of the dry air blowing plate 46 is 1.5 mm, the aperture diameter of each dry air outlet 46*a* is 4 mm and the depth of the cutout surface 46*d* from the external surface 46*e* is 0.8 mm. These sizes are free to adjust to the photosensitive material 10 appropriately. It is also desirable that the dry air blowing plate 46 is made of aluminum and its external surface is painted in black. These features make both the thermal conductivity of the dry air blowing plate 46 and the heat radiation rate to the photosensitive material 10 higher, making it possible to effectively dry the photosensitive material 10 with more amount of radiated heat energy.

The sorter section 14 sorts the dried photosensitive material 10 as conveyed from the dry section 13 by one order to another and piles it up at respective appointed places.

Now the operation of the above described embodiment, especially the drying process at the dry section 13 will be explained.

After finishing exposure recording and developing, the photosensitive material 10 is removed water on it by pairs of squeezing rollers 42 at the squeezing section 12 and then conveyed into between the conveyer belt 38 and the duct 31 in the dry section 13.

At the dry section 13, the fan 32 and the heater 33 are already driving, the temperature in the duct is kept to a specific temperature and dry air is blowing upward through dry air outlets 46*a* in the dry air blowing plate which forms the top surface of the duct. The conveyer belt 38 and the conveyer roller pairs 40 start driving at exact timing with transport of the photosensitive material 10 into the dry section 13.

The photosensitive material 10 conveyed into between the conveyer belt 38 and the dry air blowing plate 46 is pressed on the conveyer belt 38, which is placed at a given distance from the dry air blowing plate 46, by an upward force of the dry air blown through the dry air outlets 46*a*. Thus, the photosensitive material 10 is fixed on the conveyer belt 38 and conveyed along with the movement of the conveyer belt 38. Because the volume of dry air per unit area blown from the dry air blowing plate 46 is almost the same in every area of the external surface 46*e*, the surface of the photosensitive material 10 conveyed along the dry air blowing plate 46 receives evenly the dry air. This prevents irregular dry condition and allows drying evenly the photosensitive material 10. Evenness of the dry air to the surface of the photosensitive material 10 presses the photosensitive material 10 onto the conveyer belt 38 with even force and guarantees smooth transport of the photosensitive material 10 without making it slip off the conveyer belt 38.

As FIG. 5 shows, the photosensitive material 10 sometimes curls by dryness during its transport. In FIG. 5, the photosensitive material 10 is conveyed from forward to rearward of the drawing paper. If the curl of the photosensitive material 10 is strong, an edge 10*a* of the photosensitive material 10 is located near the external surface 46*e* of the dry air blowing plate 46. The edge 10*a* slips on the external surface 46*e* of the dry air blowing plate 46 unless it touches any aperture of the dry air outlets 46*a*. When the edge 10*a* enters the aperture of any dry air outlet 46*a*, it soon touches the cutout surface 46*d* that is formed in the internal periphery 46*c* by chamfering. So the edge 10*a* can slip out of the dry air outlet 46*a* as it receives upward force from the cutout surface 46*d*. Thus, the chamfer formed on the side of the external surface 46*e* in the internal periphery 46*c* of the dry air outlet 46*a* prevents the edge 10*a* of the photosensitive material 10 from being caught in the dry air outlet 46*a*, even if the photosensitive material 10 curls because of some reasons including over-dryness. Especially in the case where two or more lines of the photosensitive material 10 are conveyed side by side on the paper path, this configuration is more efficient because the number of edges 10*a* increases.

The dry air blown to the photosensitive material 10 passes through the conveyer belt 38 made from a mesh, drifts in front of the dry room 34, and is then sent into the duct 31 by the fan 32 again. Because the dry air thus recycles by driving the fan 32, it is possible to efficiently maintain for the dry air at a predetermined temperature once the dry air reaches to the predetermined temperature.

The dried photosensitive material 10 is conveyed to the sorter section 14 by being nipped by the conveyer roller pairs 40. With the completion of drying all of the photosensitive material 10, the controller 30 stops driving the fan 32, the heater 33, the conveyer mechanism and the like.

In the above described embodiment, the dry air outlet 46*a* is provided in the dry air blowing plate 46, making the aperture rate higher in the front area A1 that is close to the dry air inlet 47, and lower in the back area A2 that is away from the dry air inlet 47. If the details about the pressure on the inner surface 46*b* of the dry air blowing plate 46 are more known, it is possible to give more variety in the aperture rate than the above. For example, if the pressure on the inner surface 46*b* of the dry air blowing plate 46 is a little higher at the closest area to the dry air inlet 47, i.e. an end area of the dry air blowing plate 46, it is possible that the dry air blowing plate 46 divides into five zones according to the distance from the dry air inlet 47, so as to set the ratio between the aperture ratios of these zones is 4:5:4:4:3 in the order from the closest to the dry air inlet 47.

Figure 6:
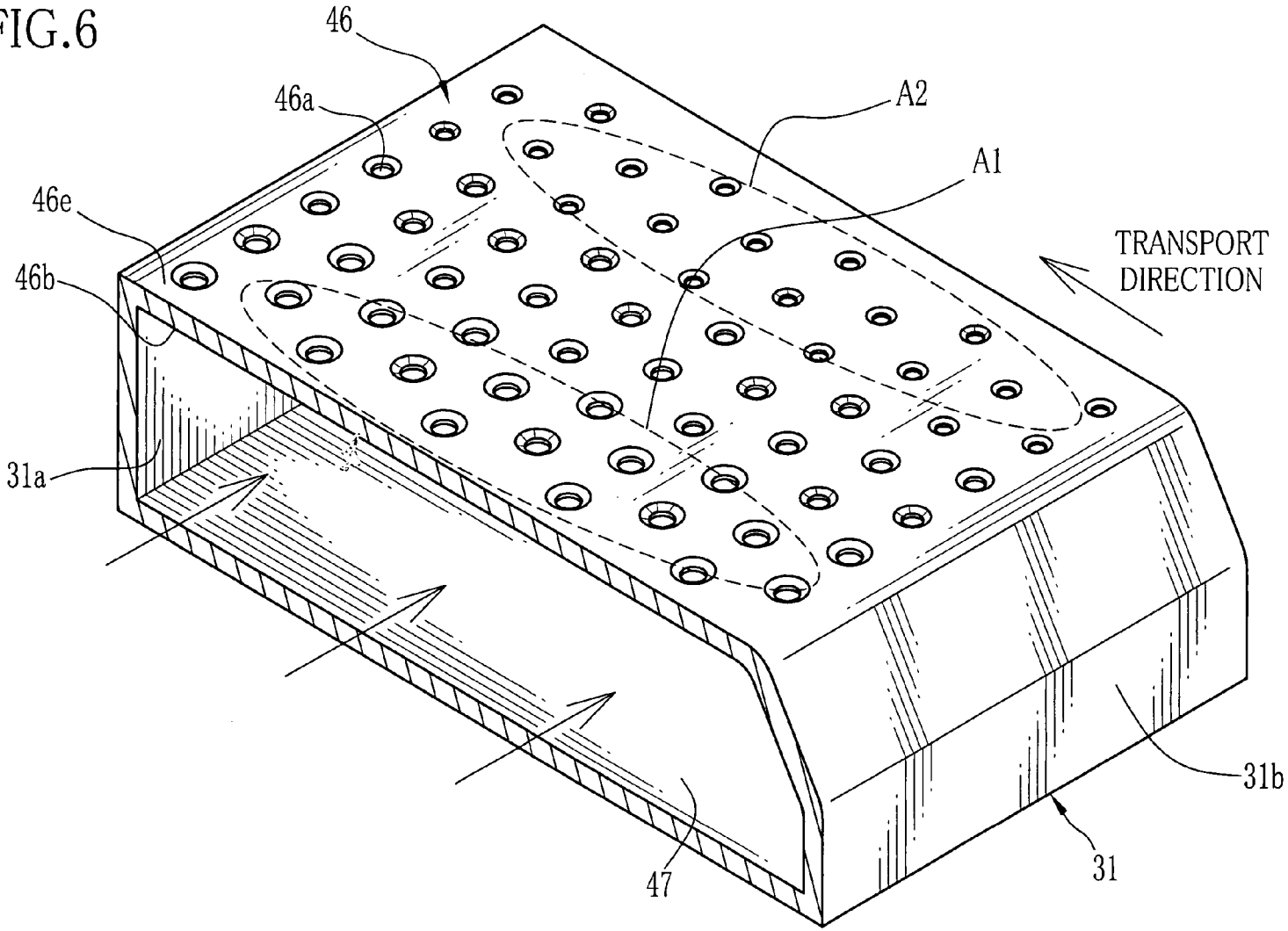
FIG. 6 is a fragmentary perspective view illustrating a duct having a dry air blowing plate on its top surface according to another embodiment.

In the above described embodiment, the dry air outlets 46*a* in the dry air blowing plate 46 are made to have a fixed aperture size, while the interval between adjacent outlets is set wider with the distance from the dry air inlet 47. Thereby, the aperture rate of the dry air outlets is made smaller as they are away from the dry air inlet 47. Instead of that, as FIG. 6 shows, it is possible to arrange respective dry air outlets 46*a* at constant intervals while making the aperture size smaller as the outlets are away from the dry air inlet 47. Moreover, it is also possible to arrange the dry air outlets 46*a* at wider intervals and make the aperture size smaller as the outlets are away from the dry air inlet 47. In the above-described embodiment, the aperture of the dry air outlet 46*a* is round. But it is possible to make the shape oval, slit, or others. In the above-described embodiment, the shape of the duct 31 is a rectangular parallelepiped. However, the duct may have another shape insofar as it can be set along the paper path 41. Moreover, the layout of the dry air inlet 47 is not limited to the above-described embodiment.

If, however, the shape of the duct 31 or the layout of the dry air inlet 47 is changed, it is necessary to adjust the aperture rate appropriately according to the location. This is because the distribution of the dry air's pressure on the inner surface 46*b* of the dry air blowing plate 46 largely vary depending upon the shape of the duct 31 and the layout of the dry air inlet 47.

Although the present invention has been described with reference to the preferred embodiments, the present invention is not to be limited to the above embodiments. On the contrary, various modifications will be possible without departing from the scope and spirit of the present invention as specified in claims appended hereto.

What is claimed is:

1. A drying device for drying a recording medium comprising:

a blower mechanism for generating dry air and sending it out;

a duct disposed along a transport path of said recording medium and supplied with the dry air from said blower mechanism, said duct comprising a dry air blowing member on a side facing to said transport path;

a plural number of air outlets formed through said dry air blowing member, to blow the dry air to said recording medium through said air outlets, wherein said air outlets are formed at a smaller aperture rate in a zone where pressure of the dry air on inner surface of said dry air blowing member is larger, said aperture rate being an area rate of apertures of said air outlets per unit area of said dry air blowing member; and a conveyer mechanism for conveying said recording medium along said transport path, said conveyer mechanism being placed across said transport path from said dry air blowing member, wherein said recording medium is held on said conveyer mechanism by virtue of the dry air blown from said air outlets to said recording medium.

2. A drying device as claimed in claim 1, wherein said duct has a parallelepiped shape, of which a first side facing to said transport path is provided with said dry air blowing member, and three of four vertical sides to said first side are closed, whereas a remaining one of said four vertical sides is provided with a dry air inlet for letting the dry air from said blower mechanism in said duct, wherein said aperture rate of said dry air blowing member is set smaller with distance from said dry air inlet.

3. A drying device as claimed in claim 2, wherein said air outlets are arranged at constant intervals, and have a smaller aperture size as said air outlets are away from said dry air inlet.

4. A drying device as claimed in claim 2, wherein said air outlets have a constant aperture size, and are arranged at wider intervals as said air outlets are away from said dry air inlet.

5. A drying device as claimed in claim 2, wherein said air outlets have a smaller aperture size and are arranged at wider intervals as said air outlets are away from said dry air inlet.

6. A drying device as claimed in claim 1, wherein said air outlets have an inner periphery chamfered on the side of said transport path.

7. A drying device as claimed in claim 1, wherein said dry air blowing member is an aluminum plate with an outer surface that faces to said transport path is painted black.

8. A drying device as claimed in claim 1, wherein said duct is placed below said transport path, and said dry air blowing member is disposed on a top face of said duct.

9. A drying device as claimed in claim 1, wherein said recording medium includes a photosensitive recording paper.

10. A drying device as claimed in claim 1, wherein said conveyer mechanism includes a conveyer belt that moves along said transport path while facing to said dry air blowing member.

* * * * *